US012043937B2

(12) United States Patent
Takei et al.

(10) Patent No.: US 12,043,937 B2
(45) Date of Patent: Jul. 23, 2024

(54) SEWING CONTROL DEVICE AND SEWING MACHINE

(71) Applicant: JANOME SEWING MACHINE Co., Ltd., Hachioji (JP)

(72) Inventors: Tatsuo Takei, Hachioji (JP); Yoshitaka Bamba, Hachioji (JP); Koji Maeda, Hachioji (JP)

(73) Assignee: JANOME CORPORATION, Hachioji (JP)

( * ) Notice: Subject to any disclaimer, the term of this patent is extended or adjusted under 35 U.S.C. 154(b) by 819 days.

(21) Appl. No.: 17/111,241

(22) Filed: Dec. 3, 2020

(65) Prior Publication Data

US 2021/0269953 A1 Sep. 2, 2021

(30) Foreign Application Priority Data

Feb. 28, 2020 (JP) ..... 2020-033705

(51) Int. Cl.

| | |
|---|---|
| ***D05B 69/30*** | (2006.01) |
| ***D05B 3/04*** | (2006.01) |
| ***D05B 21/00*** | (2006.01) |
| ***D05B 27/00*** | (2006.01) |

(52) U.S. Cl.

CPC ..... *D05B 69/30* (2013.01); *D05B 3/04* (2013.01); *D05B 21/002* (2013.01); *D05B 27/00* (2013.01)

(58) Field of Classification Search

CPC ..... D05B 69/30; D05B 3/04; D05B 21/002; D05B 27/00; D05B 27/06; D05B 27/08

See application file for complete search history.

(56) References Cited

U.S. PATENT DOCUMENTS 4,901,660 A * 2/1990 Takeuchi ..... D05B 27/08 112/470.03

FOREIGN PATENT DOCUMENTS

JP 2016-185299 A 10/2016

* cited by examiner

*Primary Examiner* — Nathan E Durham

(74) *Attorney, Agent, or Firm* — MCGINN I.P. LAW GROUP, PLLC

(57) ABSTRACT

A sewing control device includes in a sewing machine having upper feed function a control device which controls feed of an object to be sewn. A lower feed amount setting motor sets a feed amount of a lower feed dog and an upper feed amount change motor changes a feed amount of an upper feed dog. A feed execution range, in which the feed of the object to be sewn is executed by an appropriate feed amount while the object to be sewn is sandwiched between the lower feed dog and the upper feed dog, and a feed non-execution range, in which the feed of the object to be sewn is not executed in a state in which the feed dogs do not act on the object to be sewn, are present. The feed amount of the upper feed dog can be changed only in the feed non-execution range during sewing.

20 Claims, 6 Drawing Sheets

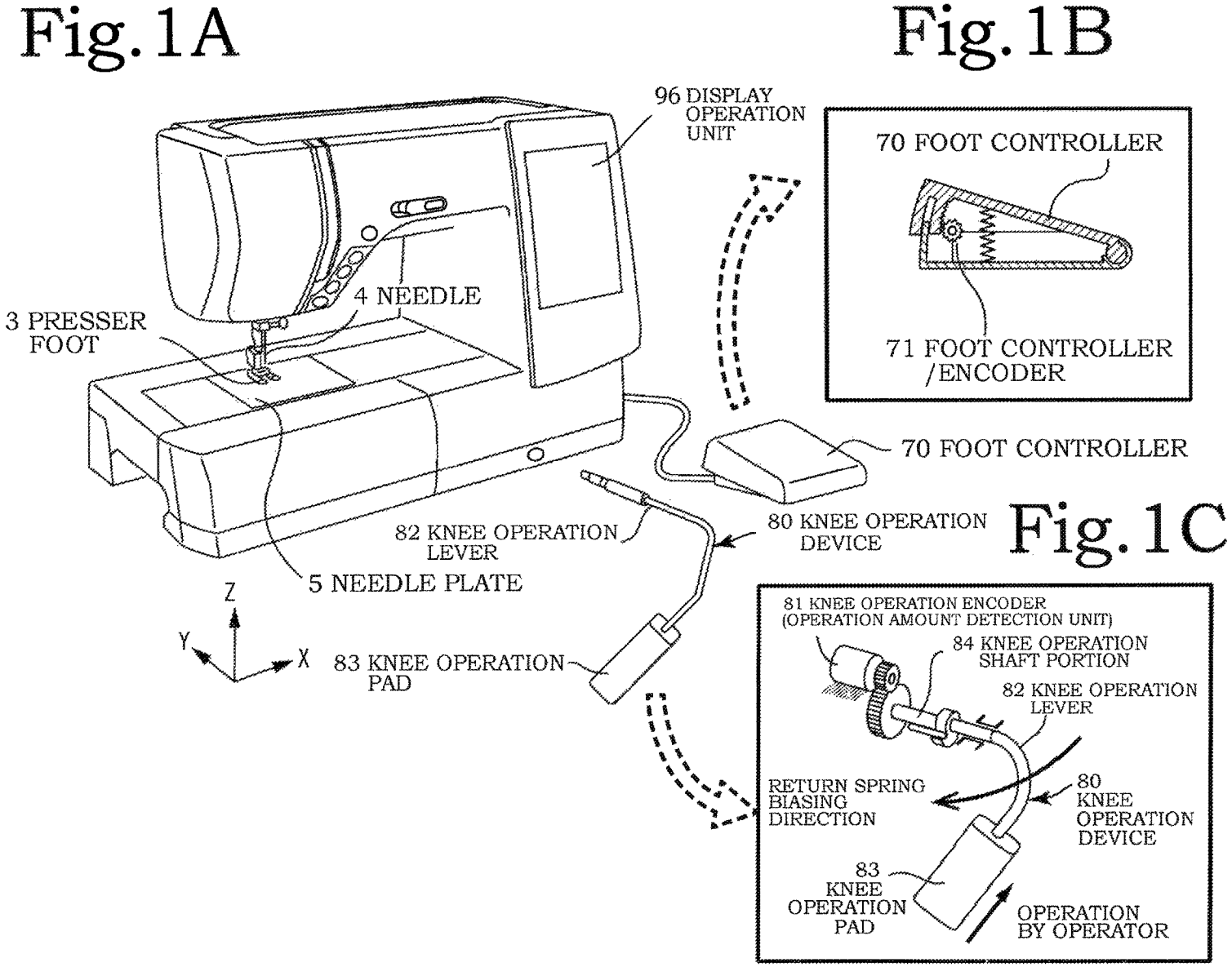
Fig.1A
Fig.1B
Fig.1C
70 FOOT CONTROLLER
71 FOOT CONTROLLER /ENCODER
70 FOOT CONTROLLER
80 KNEE OPERATION DEVICE
96 DISPLAY OPERATION UNIT
4 NEEDLE
3 PRESSER FOOT
5 NEEDLE PLATE
82 KNEE OPERATION LEVER
83 KNEE OPERATION PAD
X
Y
Z
81 KNEE OPERATION ENCODER (OPERATION AMOUNT DETECTION UNIT)
84 KNEE OPERATION SHAFT PORTION
82 KNEE OPERATION LEVER
80 KNEE OPERATION DEVICE
OPERATION BY OPERATOR
RETURN SPRING BIASING DIRECTION
83 KNEE OPERATION PAD

SEWING CONTROL DEVICE AND SEWING MACHINE

BACKGROUND OF THE INVENTION

1. Field of the Invention

The present invention relates to a sewing control device and a sewing machine capable of optionally setting a feed amount of an upper feed dog even during sewing in a sewing machine having an upper feed function.

2. Description of the Related Art

Conventionally, there are proposed various mechanisms for improving transport (feed) efficiency of a cloth in a sewing machine that performs lock stitch which uses a needle thread and a bobbin thread to an object to be sewn such as a cloth by combining movements of individual elements such as a vertical movement of a needle, a rotational movement of a shuttle, and an elliptical movement of a feed dog. For example, there is proposed so-called an upper and lower feed mechanism in which, in addition to a lower feed mechanism in which the feed dog which performs the elliptical movement is provided on the lower side of the cloth, a feed dog mechanism (upper feed mechanism) which performs the elliptical movement similarly is provided also on the upper side of the cloth, and the cloth is fed so as to be sandwiched between the mechanisms from above and from below.

In Japanese Patent Application Publication No. 2016-185299, it is proposed that, in an upper feed mechanism capable of changing an upper feed amount and a lower feed amount at one time by one driving source (lower feed amount setting motor) by using a mechanism which incorporates a front-rear movement of a lower feed mechanism into the upper feed mechanism, the upper feed amount is changed or set to zero in a preparation stage before sewing by further providing a mechanism which changes an incorporating amount. This is a technique in the stage before sewing.

Incidentally, one of effects considered to be effective in the upper and lower feed is the elimination of "sewing slippage". The "sewing slippage" denotes a phenomenon in which, when a plurality of cloths are placed on top of each other and sewn, the positional relationship between an upper cloth and a lower cloth is changed due to influences of sewing and feed. It is known that the "sewing slippage" is affected by sewing conditions such as a cloth type, a sewing speed, and a cloth thickness, and the amount of slippage changes.

In addition, for example, in sewing of a sleeve and a body, there are cases where "shirring" which sews a large sleeve part on the body while intentionally causing the sewing slippage is performed, and three-dimensional sewing conforming to the human body is performed by intentionally increasing the amount of slippage from an armpit part toward a shoulder part. The change of the amount of the sewing slippage during sewing caused by the sewing speed or the cloth thickness and control of the amount of the sewing slippage which is actively performed during sewing cannot be dealt with only by the technique in Japanese Patent Application Publication No. 2016-185299 in which the feed amount is set before sewing.

Thus, conventionally, various techniques for appropriately changing the feed amount of the upper feed dog before sewing are available. Particularly during sewing, the upper feed is driven and the cloth is fed intermittently, and hence changing the feed amount at that timing may cause, for instance, damage to a change mechanism. However, need from sewers for the change of the feed amount at the timing of the upper feed during sewing is high.

SUMMARY OF THE INVENTION

To cope with this, an object of the present invention is to implement a sewing control device of a sewing machine capable of setting a timing at which an upper feed amount can be changed even during sewing by reading from an upper shaft sensor a timing, at which the upper feed amount can be changed in a sewing cycle, and changing the upper feed amount at the timing on the basis of a change command (manual or automatic), in a sewing machine capable of changing a link ratio for transmission of a front-rear driving force of a lower feed mechanism to an upper feed mechanism.

As a result of elaborate studies conducted by the inventors for solving the above problem, a first aspect of the present invention is a sewing control device including, in a sewing machine having upper feed function, a control device which controls feed of an object to be sewn, wherein a lower feed amount setting motor for setting a feed amount of a lower feed dog and an upper feed amount change motor for changing a feed amount of an upper feed dog are controllably configured, a feed execution range, in which the feed of the object to be sewn is executed by an appropriate feed amount while the object to be sewn is sandwiched between the lower feed dog, and the upper feed dog and a feed non-execution range, in which the feed of the object to be sewn is not executed in a state in which the lower feed dog and the upper feed dog do not act on the object to be sewn, are configured to be present, and the control device controls the upper feed amount change motor such that the feed amount of the upper feed dog can be changed only in the feed non-execution range during sewing, whereby the above problem is solved.

A second aspect of the present invention is the sewing control device according to the first aspect, wherein a phase sensor which detects a timing of an upper feed operation is provided, the control device discriminates between the feed execution range and the feed non-execution range by the phase sensor, whereby the above problem is solved. A third aspect of the present invention is the sewing control device according to the first or second aspect, wherein a coupling unit which couples the lower feed dog and the upper feed dog is provided and the upper feed amount change motor changes the upper feed amount by changing a link ratio of the coupling unit, whereby the above problem is solved.

Each of fourth to sixth aspects of the present invention is the sewing control device according to any one of the first to third aspects, wherein a sewing speed detection unit which detects sewing speed, an operation amount detection unit of a knee operation device which receives an operation from an operator during sewing, and a cloth thickness detection unit which detect a thickness of the object to be sewn during sewing are provided, and the control device controls the upper feed amount change motor on the basis of a change of at least one of signals from the sewing speed detection unit, the operation amount detection unit of the knee operation device, and the cloth thickness detection unit, whereby the above problem is solved. Each of seventh to twelfth aspects of the present invention is a sewing machine including the sewing control device according to any one of the first to sixth aspects, whereby the above problem is solved.

In the present invention, it is possible to detect a timing of sewing and change the upper feed amount at a timing at which the upper feed is not performed. In particular, conventionally, it has been possible to change the upper feed amount only before sewing. However, in the present invention, the upper feed amount can be actually set appropriately during sewing according to the thickness of a cloth to be sewn or the smoothness of the cloth and, with this, sewing desired by a sewer can be performed in a shorter period of time.

BRIEF DESCRIPTION OF THE DRAWINGS

FIG. 1A is a schematic view of an entire sewing machine,

FIG. 1B is a cross-sectional view of a foot controller,

FIG. 1C is a schematic view of a knee operation device, and

DESCRIPTION OF THE PREFERRED EMBODIMENT

Figure 1D:
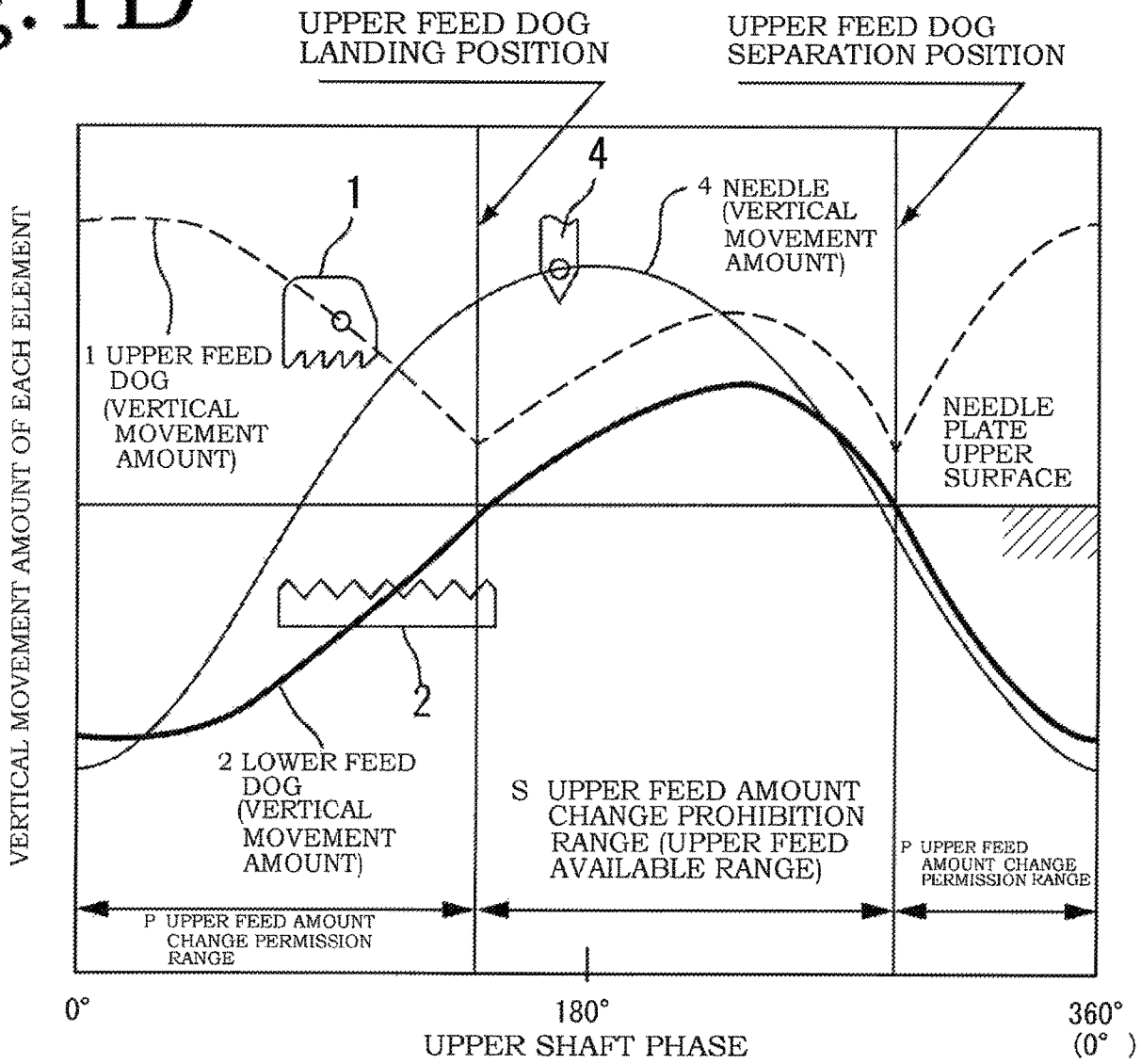
FIG. 1D is a graphic display of an upper feed amount change permission range and an upper feed amount change prohibition range.

Hereinbelow, an embodiment of the present invention will be described based on the drawings. FIG. 1A is a schematic view of an entire sewing machine. The sewing machine is a domestic sewing machine, a foot controller and a knee operation device 80 are provided in the sewing machine, and the knee operation device 80 includes a knee operation lever 82 and a knee operation pad 83.

A sewing machine operator (sewer) can operate the sewing machine with a foot controller 70 which mainly has the function of changing start/stop of the sewing machine and sewing speed by using a depressing operation of a foot in addition to a button provided in a sewing machine main body, and the knee operation device 80 which mainly has the function of changing the vertical position of a presser foot 3 (upper feed unit), a needle (drop) position, and a zigzag width.

A foot controller/encoder 71 and a knee operation encoder (an operation amount detection unit of the knee operation device 80) 81, and the like, are provided in the foot controller 70 and the knee operation device 80 respectively, and are configured so as to be able to detect not only whether the foot controller 70 and the knee operation device 80 are operated but also the operation amounts thereof.

Figure 2:
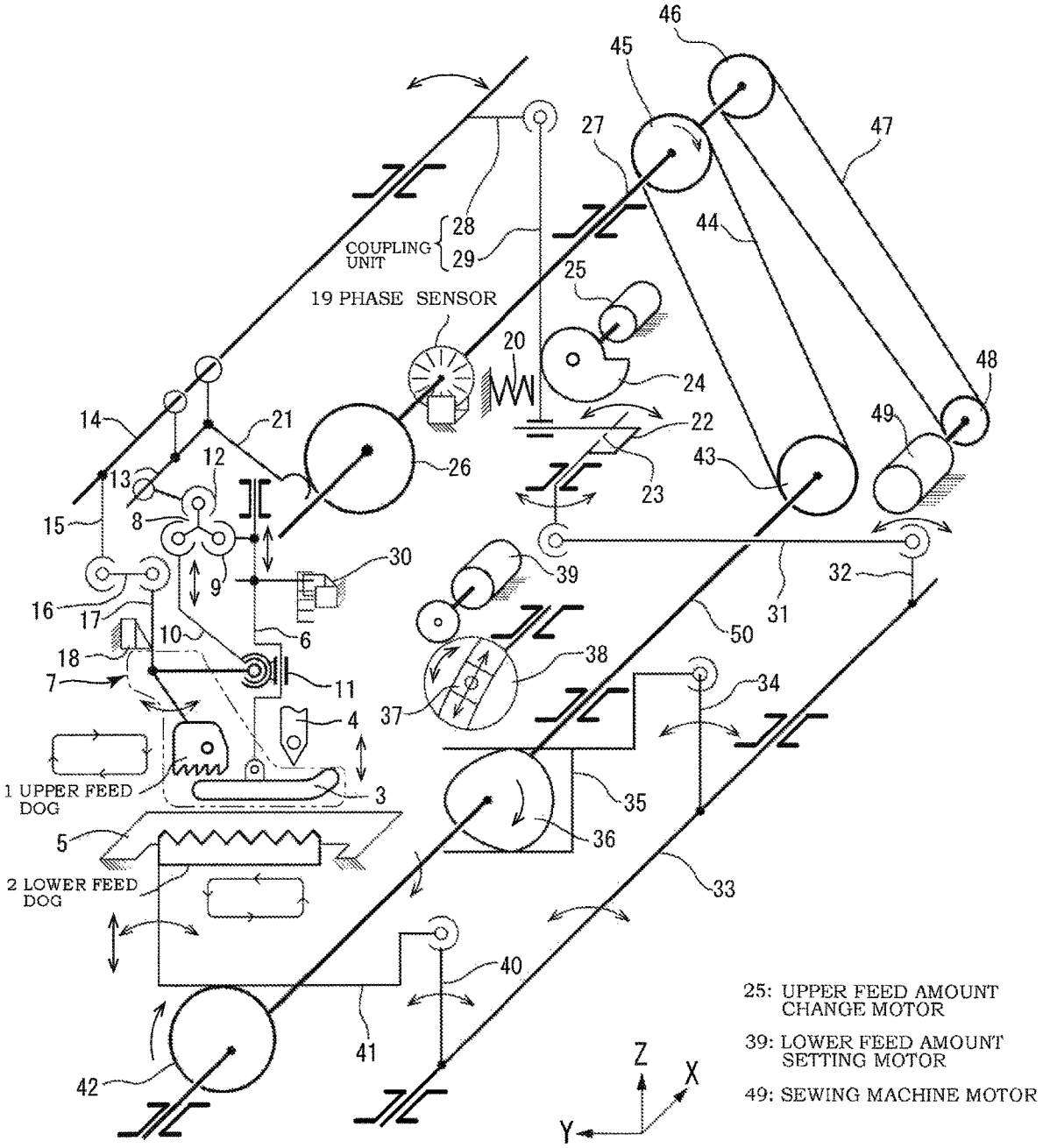
FIG. 2 is an overall perspective view of various members showing operations of an upper feed dog and a lower feed dog in the sewing machine.

FIG. 2 is an overall perspective view of various members showing operations of an upper feed dog and a lower feed dog in the sewing machine, and shows particularly the internal structure of the sewing machine to which an upper feed mechanism 7 can be attached. "1" denotes an upper feed dog, "2" denotes a lower feed dog, "3" denotes a presser foot, "4" denotes a needle, "5" denotes a needle plate, and "6" denotes a presser bar. "7" denotes an upper feed mechanism, "8" denotes a triangular link, "9" denotes a presser release link, "10" denotes an upper and lower feed coupling plate, "11" denotes an upper feed coupling body, "12" denotes an upper feed vertical link, "13" denotes an upper feed vertical arm, "14" denotes an upper feed upper shaft, "15" denotes an upper feed upper shaft front arm, "16" denotes a horizontal intermediate link, "17" denotes an upper feed leg, and "18" denotes an upper feed unit detection sensor.

Further, a phase sensor 19 plays a role as an angle sensor which measures an angle of an upper shaft 27. "20" denotes a compression spring, "21" denotes an upper feed vertical cam contact portion, "22" denotes an upper feed amount change link, "23" denotes the rotation center of the upper feed amount change link, "24" denotes an upper feed coupling link drive cam, "25" denotes an upper feed amount change motor, "26" denotes an upper feed vertical drive cam, "28" denotes an upper feed upper shaft rear arm, "29" denotes an upper feed coupling link, and "30" denotes a presser foot height encoder (=cloth thickness encoder=cloth thickness detection unit). "31" denotes a horizontal feed coupling link, "32" denotes a horizontal feed shaft rear arm, "33" denotes a horizontal feed shaft, and "34" denotes a horizontal feed shaft intermediate arm. In addition, the upper feed amount change link 22 and the upper feed coupling link 29 are referred to as a coupling unit.

"35" denotes a feed fork, "36" denotes a horizontal feed cam, "37" denotes a square die, "38" denotes a feed setting device, "39" denotes a lower feed amount setting motor, "40" denotes a horizontal feed shaft front arm, "41" denotes a lower feed bar, "42" denotes a lower feed vertical cam, "43" denotes a lower shaft pulley, "44" denotes a upper and lower shaft toothed belt, "45" denotes an upper shaft pulley, "46" denotes an upper shaft motor pulley, "47" denotes a sewing machine motor toothed belt, "48" denotes a motor pulley, "49" denotes a sewing machine motor, and "50" denotes a lower shaft.

By using the rotational force of the sewing machine motor 49 as a driving source, a vertical movement of the needle 4, driving of the lower feed dog 2, and driving of the upper feed dog 1 are performed via the upper shaft 27. The link ratio of the upper feed coupling link 29 serving as a link which incorporates a front-rear movement of the lower feed dog 2 into the upper feed can be changed. That is, by changing the coupling position of the upper feed coupling link 29 in the upper feed amount change link 22 with the upper feed coupling link drive cam 24 and the upper feed amount change motor 25, it is possible to change a ratio at which the front-rear movement of the lower feed dog 2 is incorporated into the upper feed dog 1.

In addition, it is possible to detect the thickness of a sandwiched cloth by detecting the presser foot height from the needle plate with the presser foot height encoder 30 provided in the presser bar 6 to which the presser foot is attached, and hence it is possible to cause the presser foot height encoder 30 to function as the cloth thickness detection unit. Further, the phase sensor 19 is provided in the upper shaft 27, and it is possible to detect the angle of the upper shaft, i.e., the positions of the needle 4 and the upper feed dog 1 (timing of sewing).

In addition, a sewing speed detection unit for detecting the sewing speed is provided in the sewing machine. A sensor or the like for detecting the sewing speed may be provided separately. However, in the present embodiment, the above-described phase sensor 19 is used also as the sewing speed detection unit, the rotational speed of the upper shaft is calculated by detecting, e.g., a time interval of specific angle signals of the upper shaft which are intermittently output from the phase sensor 19 during sewing by the sewing machine, and the sewing speed is calculated from the rotational speed of the upper shaft.

Figure 3:
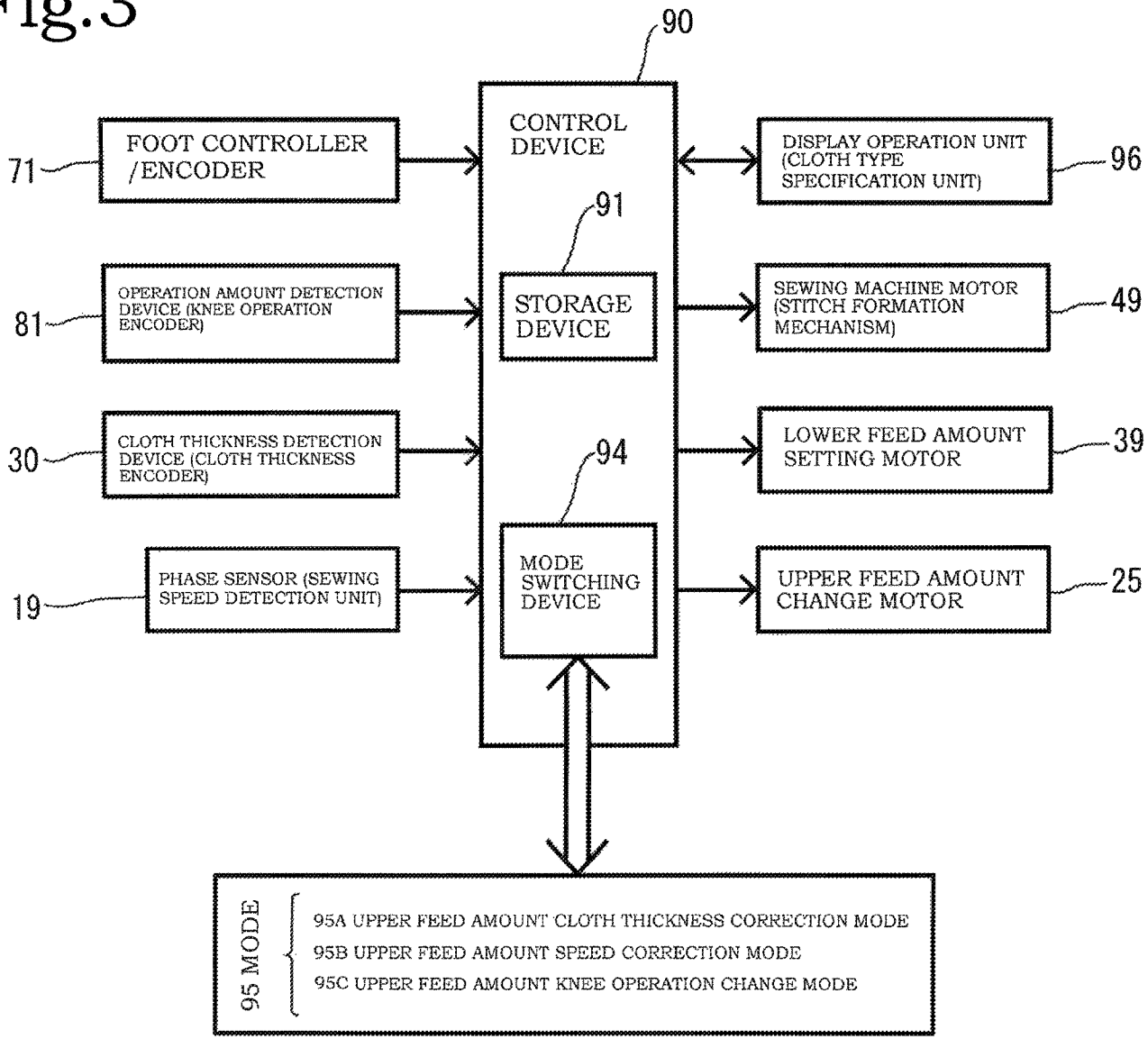
FIG. 3 is a block diagram of control constituting the present invention.

FIG. 3 is a block diagram of a control device 90 of the sewing machine and, to the control device 90, the foot controller/encoder 71, the knee operation encoder (operation amount detection unit) 81, the cloth thickness detection unit 30, and the phase sensor (sewing speed detection unit) 19 described above are connected. Further, in addition to the sewing machine motor 49, the lower feed amount setting motor 39 for changing the lower feed amount, and the upper feed amount change motor 25 for changing the upper feed amount (to be precise, changing the link ratio of the lower feed driving transmitted to the upper feed mechanism) are connected.

Figure 4A:
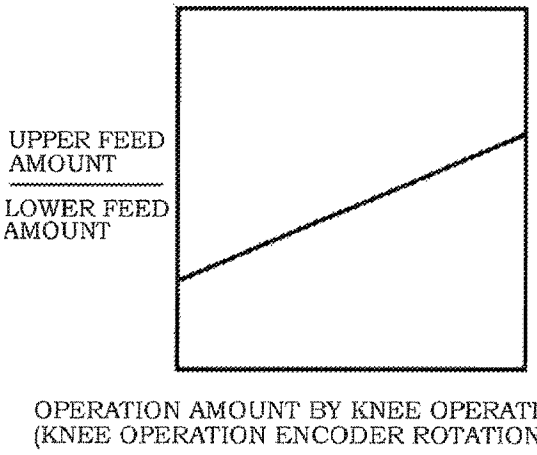
FIG. 4A is a view of an upper feed amount change setting value related to a knee operation lever operation amount.
Figure 4B:
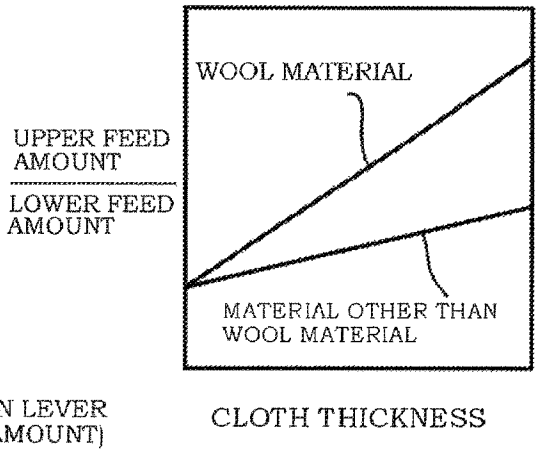
FIG. 4B is a view of an upper feed amount change setting value related to a cloth thickness.
Figure 4C:
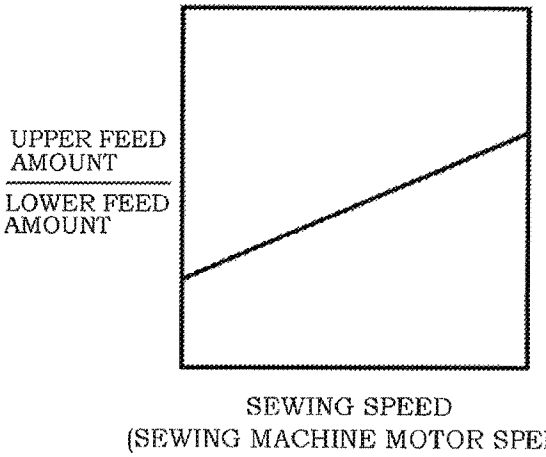
FIG. 4C is a view of an upper feed amount change setting value related to sewing speed.

In addition, in a storage device 91 in the control device 90 of the sewing machine, change setting values shown in FIGS. 4A to 4C are stored as data. Further, an appropriate mode 95 that determines which one of changes of the values is used to change the upper feed amount is also stored. A mode switching device 94 for switching the mode 95 (an upper feed amount cloth thickness correction mode ON/OFF: 95A, an upper feed amount speed correction mode ON/OFF: 95B, and an upper feed amount knee operation change mode ON/OFF: 95C) is also provided.

FIGS. 4A to 4C show the upper feed amount change setting value corresponding to the change of the encoder value or the detection value of the detection unit. The driving source for the front-rear driving of the upper feed mechanism is the lower feed mechanism, and hence, when the link ratio is one to one, the ratio between the upper feed amount and the lower feed amount is 1:1. However, due to fluctuations in frictional force or inertial force caused by differences in sewing speed, cloth type, and cloth thickness, a relative difference is caused between the feed amount of the upper cloth and the feed amount of the lower cloth, and sewing slippage in which the upper and lower cloths are misaligned and sewn occurs.

To cope with this, in order to correct the slippage, a large cloth feed amount is set as the lower feed amount in a situation in which the sewing slippage is expected to occur frequently. The tendency differs according to the cloth type, and hence a table (formula) for correction on the side of the sewing machine is selected based on cloth type information input by an operator before sewing. In addition, by changing the upper feed amount according to the knee operation lever operation amount by the operator, it becomes possible to cope with complicated sewing which intentionally causes sewing slippage such as sewing of an upper part of a sleeve.

FIG. 1D is a graphic display of an upper feed amount change permission range P and an upper feed amount change prohibition range S and, as shown in FIG. 2, each of the lower feed dog 2 and the upper feed dog 1 has an elliptical locus and is driven. When the lower feed dog 2 has moved upward and the upper feed dog 1 has moved downward, the cloth is sandwiched between the lower feed dog 2 and the upper feed dog 1, and the lower feed dog 2 and the upper feed dog 1 move rearward (a direction of Y in FIG. 1A) while sandwiching the cloth therebetween, whereby the cloth is fed. Thereafter, the lower feed dog 2 moves downward and the upper feed dog 1 moves upward, and hence the sandwiching of the cloth is released. By performing these operations successively, the cloth is fed intermittently between stitch formations.

With regard to the driving of the lower feed dog 2 and the upper feed dog 1, FIG. 1D shows a positional relationship in a vertical direction in particular as a diagram. The vertical position of the needle 4 is also shown such that, in particular, a relationship with timing of stitch formation can be seen. As described above, it can be seen that, at a timing at which the stitch formation has been ended and the needle 4 has ascended, the upper feed dog 1 descends and, at the same time, the lower feed dog 2 ascends, the upper and lower feed dogs come into contact with each other at an upper feed dog landing position via the cloth, and the cloth is sandwiched between the upper and lower feed dogs.

From the upper feed dog landing position to an upper feed dog separation position, the upper feed dog 1 is in an ascent state due to the physical push-up force of the lower feed dog 2. That is, the upper feed dog 1 ascends from the upper feed dog landing position until the feed is completed and the lower feed dog 2 descends from a coupled state (upper feed dog separation position), whereby the sandwiching state is released. Based on the above operations, a phase in which the upper feed dog 1 and the lower feed dog 2 do not feed the cloth in cooperation with each other, i.e., force by feeding does not act on the upper feed dog 1 is used as the upper feed amount change permission range P, a phase other than the above phase is used as the upper feed amount change prohibition range S, and the ranges are detected by the phase sensor 19 described above.

Figure 5:
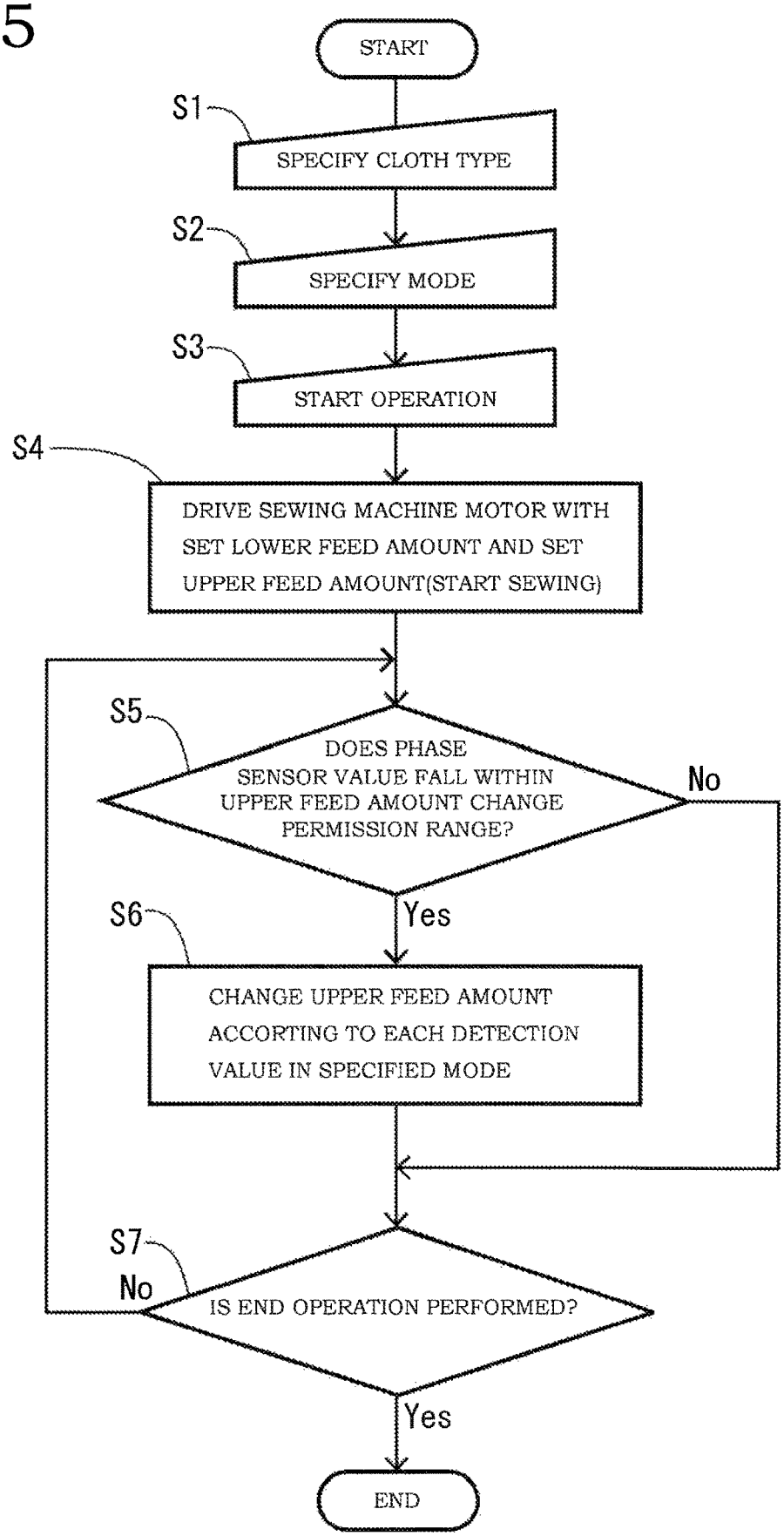
FIG. 5 is a flowchart constituting the present invention.

FIG. 5 is a flowchart showing a series of operations of the sewing machine. First, as a preparation stage before sewing, the sewing machine operator operates the sewing machine to specify the cloth type (S1), and also specify the mode 95 of the upper feed (S2). Subsequently, the sewing machine operator operates the sewing machine to start the sewing machine (S3), and starts sewing by driving the sewing machine motor 49 with the set lower feed amount and the set upper feed amount (S4). During the sewing, the control device 90 of the sewing machine performs the sewing while changing the sewing speed with a signal from the foot controller 70 operated by the sewing machine operator. In addition, the sewing machine operator operates the knee operation lever 82 during the sewing in order to optionally change the upper feed amount on an as needed basis.

On the other hand, the control device 90 determines whether or not the value of the phase sensor 19 falls within the upper feed amount change permission range P and, when the value falls within the upper feed amount change permission range P, the control device 90 detects whether or not the knee operation encoder value (an output value of the operation amount detection unit), an output value of the sewing speed detection unit, or an output value of the cloth thickness detection unit is changed, and changes the upper feed amount according to the specified cloth type and the change of the output value based on the specified mode and performs the sewing (S6). Thus, even during sewing, it is possible to perform optimum sewing. The control operations (S5) and (S6) are repeatedly performed until the sewing is ended and, when an end operation is performed (S7: YES), sewing operations are ended.

In addition, as shown in FIG. 1D, the upper feed amount change permission range P is referred to as a feed execution range, and the upper feed amount change prohibition range S (upper feed available range) is referred to as a feed non-execution range.

Note that, in the present embodiment, the upper feed available range in which the cloth is sandwiched between the upper feed dog 1 and the lower feed dog 2 is used as the upper feed amount change prohibition range S, but the present invention is not limited thereto. For example, the upper feed amount change prohibition range S>the upper feed available range, i.e., the upper feed amount change permission range P may also be set to a range narrower than that in the present embodiment. With this, it is possible to change the feed amount of the upper feed dog with the upper feed amount change motor more safely.

In a second aspect of the present invention, with the presence of the phase sensor, it is possible to control the change of the upper feed amount reliably. In a third aspect of the present invention, the upper feed amount change motor has an advantage that it is possible to change the upper feed amount easily and reliably by changing the upper feed amount by changing the link ratio of the coupling unit. In addition, in each of fourth to sixth aspects of the present invention, the upper feed amount change motor is controlled based on the change of at least one of the signals of the sewing speed detection unit, the operation amount detection unit of the knee operation device, and the cloth thickness detection unit, and hence the effect of being able to set the upper feed amount to an extremely proper value is achieved. Further, in each of seventh to twelfth aspects of the present invention, it is possible to provide the sewing machine as the sewing machine capable of controlling the upper feed amount.

What is claimed is:

1. A sewing control device comprising, in a sewing machine including upper feed function, a control device which controls feed of an object to be sewn, wherein a lower feed amount setting motor for setting a feed amount of a lower feed dog and an upper feed amount change motor for changing a feed amount of an upper feed dog are controllably configured, a feed execution range, in which the feed of the object to be sewn is executed by an appropriate feed amount while the object to be sewn is sandwiched between the lower feed dog and the upper feed dog, and a feed non-execution range, in which the feed of the object to be sewn is not executed in a state in which the lower feed dog and the upper feed dog do not act on the object to be sewn, are configured to be present, and the control device controls the upper feed amount change motor such that the feed amount of the upper feed dog is changed only at a timing when the feed non-execution range is determined during a sewing cycle on a basis of a received change command.

2. The sewing control device according to claim 1, wherein a phase sensor which detects a timing of an upper feed operation is provided and the control device discriminates between the feed execution range and the feed non-execution range by the phase sensor, and wherein the sewing cycle includes a vertical movement of a needle.

3. The sewing control device according to claim 2, wherein a sewing speed detection unit which detects a sewing speed, an operation amount detection unit of a knee operation device which receives an operation from an operator during sewing, and a cloth thickness detection unit which detects a thickness of the object to be sewn during sewing are provided, and the control device controls the upper feed amount change motor on the basis of a change of at least one of signals from the sewing speed detection unit, the operation amount detection unit of the knee operation device, and the cloth thickness detection unit.

4. The sewing control device according to claim 2, wherein a coupling unit which couples the lower feed dog and the upper feed dog is provided, and the upper feed amount change motor changes the upper feed amount by changing a link ratio of the coupling unit.

5. The sewing control device according to claim 1, wherein a coupling unit which couples the lower feed dog and the upper feed dog is provided, and the upper feed amount change motor changes the upper feed amount by changing a link ratio of the coupling unit.

6. The sewing control device according to claim 5, wherein a sewing speed detection unit which detects a sewing speed, an operation amount detection unit of a knee operation device which receives an operation from an operator during sewing, and a cloth thickness detection unit which detects a thickness of the object to be sewn during sewing are provided, and the control device controls the upper feed amount change motor on the basis of a change of at least one of signals from the sewing speed detection unit, the operation amount detection unit of the knee operation device, and the cloth thickness detection unit.

7. The sewing control device according to claim 1, further comprising a storage device storing change setting values and a plurality of sewing modes that determine which one of changes of the values is used to change the upper feed amount.

8. The sewing control device according to claim 7, further comprising a mode switching device switching between the plurality of sewing modes.

9. A sewing control device comprising, in a sewing machine having upper feed function, a control device which controls feed of an object to be sewn, wherein a lower feed amount setting motor for setting a feed amount of a lower feed dog and an upper feed amount change motor for changing a feed amount of an upper feed dog are controllably configured, a feed execution range, in which the feed of the object to be sewn is executed by an appropriate feed amount while the object to be sewn is sandwiched between the lower feed dog and the upper feed dog, and a feed non-execution range, in which the feed of the object to be sewn is not executed in a state in which the lower feed dog and the upper feed dog do not act on the object to be sewn, are configured to be present, and the control device controls the upper feed amount change motor such that the feed amount of the upper feed dog can be changed only in the feed non-execution range during sewing, wherein a sewing speed detection unit which detects a sewing speed, an operation amount detection unit of a knee operation device which receives an operation from an operator during sewing, and a cloth thickness detection unit which detect a thickness of the object to be sewn during sewing are provided, and the control device controls the upper feed amount change motor on the basis of a change of at least one of signals from the sewing speed detection unit, the operation amount detection unit of the knee operation device, and the cloth thickness detection unit.

10. A sewing machine comprising the sewing control device according to claim 1.

11. A sewing machine comprising the sewing control device according to claim 2.

12. A sewing machine comprising the sewing control device according to claim 5.

13. A sewing machine comprising the sewing control device according to claim 9.

14. A sewing machine comprising the sewing control device according to claim 3.

15. A sewing machine comprising the sewing control device according to claim 6.

16. A sewing machine including an upper feed function, comprising:

a storage device storing change setting values; and a control device which controls feed of an object to be sewn, the control device being configured to:

control a lower feed amount setting motor for setting a feed amount of a lower feed dog and an upper feed amount change motor for changing a feed amount of an upper feed dog;

determine a feed execution range, in which the feed of the object to be sewn is executed by an appropriate feed amount while the object to be sewn is sandwiched between the lower feed dog and the upper feed dog, and a feed non-execution range, in which the feed of the object to be sewn is not executed in a state in which the lower feed dog and the upper feed dog do not act on the object to be sewn;

receive a change command;

control the upper feed amount change motor from the stored change setting values such that the feed amount of the upper feed dog is changed only at a timing when the feed non-execution range is determined during a sewing cycle on a basis of the received change command.

17. The sewing machine according to claim 16, further comprising a phase sensor which detects a timing of an upper feed operation is provided and the control device discriminates between the feed execution range and the feed non-execution range by the phase sensor, wherein the sewing cycle includes a vertical movement of a needle.

18. The sewing machine according to claim 16, further comprising a coupling unit which couples the lower feed dog and the upper feed dog is provided, and the upper feed amount change motor changes the upper feed amount by changing a link ratio of the coupling unit.

19. The sewing machine according to claim 16, further comprising:

a sewing speed detection unit which detects a sewing speed, an operation amount detection unit of a knee operation device which receives an operation from an operator during sewing; and a cloth thickness detection unit which detect a thickness of the object to be sewn during sewing are provided, and the control device controls the upper feed amount change motor on the basis of a change of at least one of signals from the sewing speed detection unit, the operation amount detection unit of the knee operation device, and the cloth thickness detection unit.

20. The sewing machine according to claim 16, wherein the storage device storing data for a plurality of sewing modes that determine which one of changes of the values is used to change the upper feed amount, further comprising a mode switching device switching between the plurality of sewing modes.

* * * * *